US010739079B2

(12) United States Patent
Lowenstein

(10) Patent No.: US 10,739,079 B2
(45) Date of Patent: Aug. 11, 2020

(54) DEWPOINT INDIRECT EVAPORATIVE COOLER

(71) Applicant: AIL RESEARCH INC., Hopewell, NJ (US)

(72) Inventor: Andrew Lowenstein, Princeton, NJ (US)

(73) Assignee: AIL RESEARCH INC., Hopewell, NJ (US)

( * ) Notice: Subject to any disclaimer, the term of this patent is extended or adjusted under 35 U.S.C. 154(b) by 222 days.

(21) Appl. No.: 15/112,114

(22) PCT Filed: Jan. 15, 2015

(86) PCT No.: PCT/US2015/011640
§ 371 (c)(1),
(2) Date: Jul. 15, 2016

(87) PCT Pub. No.: WO2015/109113
PCT Pub. Date: Jul. 23, 2015

(65) Prior Publication Data

US 2016/0327345 A1 Nov. 10, 2016

Related U.S. Application Data

(60) Provisional application No. 61/928,114, filed on Jan. 16, 2014.

(51) Int. Cl.
*F28D 9/00* (2006.01)
*F28F 3/02* (2006.01)
*F28D 5/00* (2006.01)

(52) U.S. Cl.
CPC ..... *F28D 9/0093* (2013.01); *F28D 5/00* (2013.01); *F28D 9/0068* (2013.01); *F28F 3/027* (2013.01)

(58) Field of Classification Search
CPC ..... F28D 5/00; F28D 9/0093
(Continued)

(56) References Cited

U.S. PATENT DOCUMENTS 2,174,060 A 9/1939 Niehart
5,453,223 A 9/1995 Maisotsenko
(Continued)

FOREIGN PATENT DOCUMENTS

WO WO-9108424 A1 * 6/1991 ..... F24F 1/0007
WO 2013188388 A2 12/2013

OTHER PUBLICATIONS

Translation of WO 9108424 A1 entitled Translation—WO 9108424 A1 (Year: 2019).*
(Continued)

*Primary Examiner* — Paul Alvare
(74) *Attorney, Agent, or Firm* — Amster, Rothstein & Ebenstein LLP

(57) ABSTRACT

A plate for a heat exchanger including front and back external surfaces, a periphery, one or more dry internal passages through which a fluid flows parallel to the first and second stream-wise edges, and an internal frame. The frame is coincident with the periphery of the plate. The front edge section and the back edge section of the frame permit a fluid to flow into and out of the internal passages of the plate. The frame is bonded to the front and back external surfaces of the plate around the plate's periphery. The plate further includes fins or other protuberances that enhance heat transfer between a fluid flowing within the plate and the external surfaces of the plate, the fins or other protuberances being located within a volume defined by the frame and the plate's external surfaces.

12 Claims, 6 Drawing Sheets

(58) Field of Classification Search
USPC ..... 165/166
See application file for complete search history.

(56) References Cited

U.S. PATENT DOCUMENTS

| | | | | |
|---|---|---|---|---|
| 5,829,513 | A * | 11/1998 | Urch | F24F 12/006 165/54 |
| 6,182,747 | B1 | 2/2001 | Stark | |
| 2006/0124287 | A1* | 6/2006 | Reinders | F24F 5/0035 165/166 |
| 2006/0156750 | A1* | 7/2006 | Lowenstein | F24F 3/1417 62/271 |
| 2007/0163772 | A1* | 7/2007 | Bhatti | F28F 1/126 165/202 |
| 2008/0000624 | A1 | 1/2008 | Symonds et al. | |
| 2008/0042306 | A1* | 2/2008 | Reinders | F24F 5/0035 261/153 |
| 2011/0122267 | A1 | 6/2011 | Sim et al. | |
| 2011/0179807 | A1 | 7/2011 | Holloway et al. | |
| 2014/0260398 | A1* | 9/2014 | Kozubal | F25B 15/00 62/271 |
| 2015/0292811 | A1* | 10/2015 | Lowenstien | F28F 13/06 62/304 |

OTHER PUBLICATIONS

International Search Report of PCT/US2015/011640 dated Sep. 1, 2015.
Written Opinion of the International Searching Authority of PCT/US2015/011640 dated Sep. 1, 2015.

* cited by examiner

DEWPOINT INDIRECT EVAPORATIVE COOLER

RELATED APPLICATION

This application is a U.S. national phase application based on and claiming priority to PCT International Application No. PCT/US15/11640, filed Jan. 15, 2015, which in turn claims priority to U.S. Provisional Patent Application No. 61/928,114, filed Jan. 16, 2014, the contents of which are incorporated herein by reference in their entirety.

FIELD

This application is related generally to heat and mass exchangers, and in particular to evaporative coolers.

BACKGROUND OF THE INVENTION

In dry climates, evaporative coolers can be a more efficient alternative to a compressor-based air conditioner for creating comfortable indoor conditions. The simplest evaporative coolers, often called either direct evaporative coolers or swamp coolers, flow dry, hot outdoor air through a wetted, porous pad. The evaporation that occurs in the pad both drops the temperature and increases the humidity of the air. The lowest temperature that can be achieved in a direct evaporative cooler is the wet-bulb temperature of the entering air.

Indirect evaporative coolers improve upon simple swamp coolers by using a heat exchanger to separate the process air that is to be delivered to the building from a second air stream that evaporates water to produce a cooling effect. The two air streams flow on opposite sides of the heat exchanger so the process air is cooled without gaining humidity. However, as with the direct evaporative cooler, the wet-bulb temperature of the cooling air sets the lower limit for the temperature of the delivered process air.

In 1939, W. M. Niehart received U.S. Pat. No. 2,174,060 for an improved indirect evaporative cooler in which the cooling air itself is first evaporatively cooled before it comes in contact with the wetted surface of the indirect evaporative cooler. Because the wet-bulb temperature of the cooling air has been lowered before it contacts the wetted surface, Niehart's invention can cool the process air to a temperature that is below the initial wet-bulb temperature of the cooling air. In most applications, the initial dewpoint temperature of the cooling air is the lower limit for the temperature of the delivered process air. Since the air's dewpoint temperature is always lower than its wet-bulb temperature when the air is unsaturated, Niehart's invention, which will be referred to as a dewpoint indirect evaporative cooler (DIEC), can supply air at a lower temperature than a conventional indirect evaporative cooler.

In 1955, V. Maisotsenko received U.S. Pat. No. 5,453,223 for an alternative configuration of a DIEC. Coolerado Corporation of Denver, Colo., USA now manufactures and sells a DIEC based on the technology invented by Maisotsenko. Seeley International of Adelaide, South Australia and StatiqCooling BV of Amsterdam, Netherlands now manufacture and sell DIECs that more closely embody the principals illustrated in the Niehart patent.

SUMMARY OF THE INVENTION

An object of the present invention is to provide an improved embodiment of a DIEC that will have lower air-side pressure drops, lower water use and higher thermal efficiency than DIECs that are now commercially available. A DIEC according to an exemplary embodiment of the present invention is composed of two or more spaced apart, vertical plates, each plate having front and back external surfaces, top and bottom horizontal edges, first and second vertical edges, and one or more dry internal passages.

A plate for a heat exchanger according to an exemplary embodiment of the present invention comprises: front and back external surfaces; a periphery defined by a first stream-wise edge, an opposed second stream-wise edge, a first cross-stream edge and an opposed second cross-stream edge; one or more dry internal passages through which a fluid flows parallel to the first and second stream-wise edges; an internal frame, wherein: (a) the frame is coincident with the periphery of the plate, (b) the frame has a front edge section parallel to and in proximity to the plate's first cross-stream edge, an opposed back edge section parallel to and in proximity to the plate's second cross-stream edge, a first stream-wise edge section parallel to and in proximity to the plate's first stream-wise edge, and an opposed second stream-wise edge section parallel to and in proximity to the plate's second stream-wise edge, (c) the front edge section and the back edge section permit a fluid to flow into and out of the internal passages of the plate, and (d) the frame is bonded to the front and back external surfaces of the plate around the plate's periphery; the plate further comprising fins or other protuberances that enhance heat transfer between a fluid flowing within the plate and the external surfaces of the plate, the fins or other protuberances being located within a volume defined by the frame and the plate's external surfaces.

In at least one exemplary embodiment, the frame is made from a polymer.

In at least one exemplary embodiment, the external surfaces are metal foils having a thickness equal to or less than 4 mil.

In at least one exemplary embodiment, at least one cross-stream edge section has a thickness that is less than a thickness of the stream-wise edge sections.

In at least one exemplary embodiment, the at least one cross-stream edge section provides a turning region in which the fluid is directed at a nonzero angle relative to the first and second stream-wise edges.

In at least one exemplary embodiment, the plate further comprises a wick that covers a substantial fraction of one or both external surfaces, the wick being a thin sheet for uniformly spreading a liquid so that the plate is adapted for mass exchange.

A heat and mass exchanger according to an exemplary embodiment of the present invention comprises: (a) two or more vertically oriented and spaced apart plates, each of the two or more plates comprising: front and back external surfaces; a wick that covers a substantial fraction of at least one of the front and back external surfaces, the wick being a thin sheet for uniformly spreading a liquid so that the plate is adapted for mass exchange; a periphery defined by a first stream-wise edge, an opposed second stream-wise edge, a first cross-stream edge and an opposed second cross-stream edge; one or more dry internal passages through which a fluid flows parallel to the first and second stream-wise edges; an internal frame, wherein: (i) the frame is coincident with the periphery of the plate, (ii) the frame has a front edge section parallel to and in proximity to the plate's first cross-stream edge, an opposed back edge section parallel to and in proximity to the plate's second cross-stream edge, a first stream-wise edge section parallel to and in proximity to the plate's first stream-wise edge, and an opposed second stream-wise edge section parallel to and in proximity to the plate's second stream-wise edge, (iii) the front edge section and the back edge section permit a fluid to flow into and out of the internal passages of the plate, and (iv) the frame is bonded to the front and back external surfaces of the plate around the plate's periphery; and fins or other protuberances that enhance heat transfer between a fluid flowing within the plate and the external surfaces of the plate, the fins or other protuberances being located within a volume defined by the frame and the plate's external surfaces; (b) means for delivering a liquid to the wicks in proximity to the uppermost stream-wise edge of the plate, (c) means for directing a first air stream into the plates at their first cross-stream edge and out of the plates at their second cross-stream edge, (d) means for directing a second air stream to flow in the gaps between the plates in contact with the liquid-wetted wicks so that mass is exchanged between the second air stream and the liquid.

In at least one exemplary embodiment, the liquid is water.

In at least one exemplary embodiment, the liquid is a liquid desiccant.

BRIEF DESCRIPTION OF THE DRAWINGS

The above and related objects, features and advantages of the present invention will be more fully understood by reference to the following, detailed description of the preferred, albeit illustrative, embodiment of the present invention when taken in conjunction with the accompanying figures, wherein.

DETAILED DESCRIPTION OF THE PREFERRED EMBODIMENTS

Figure 1:
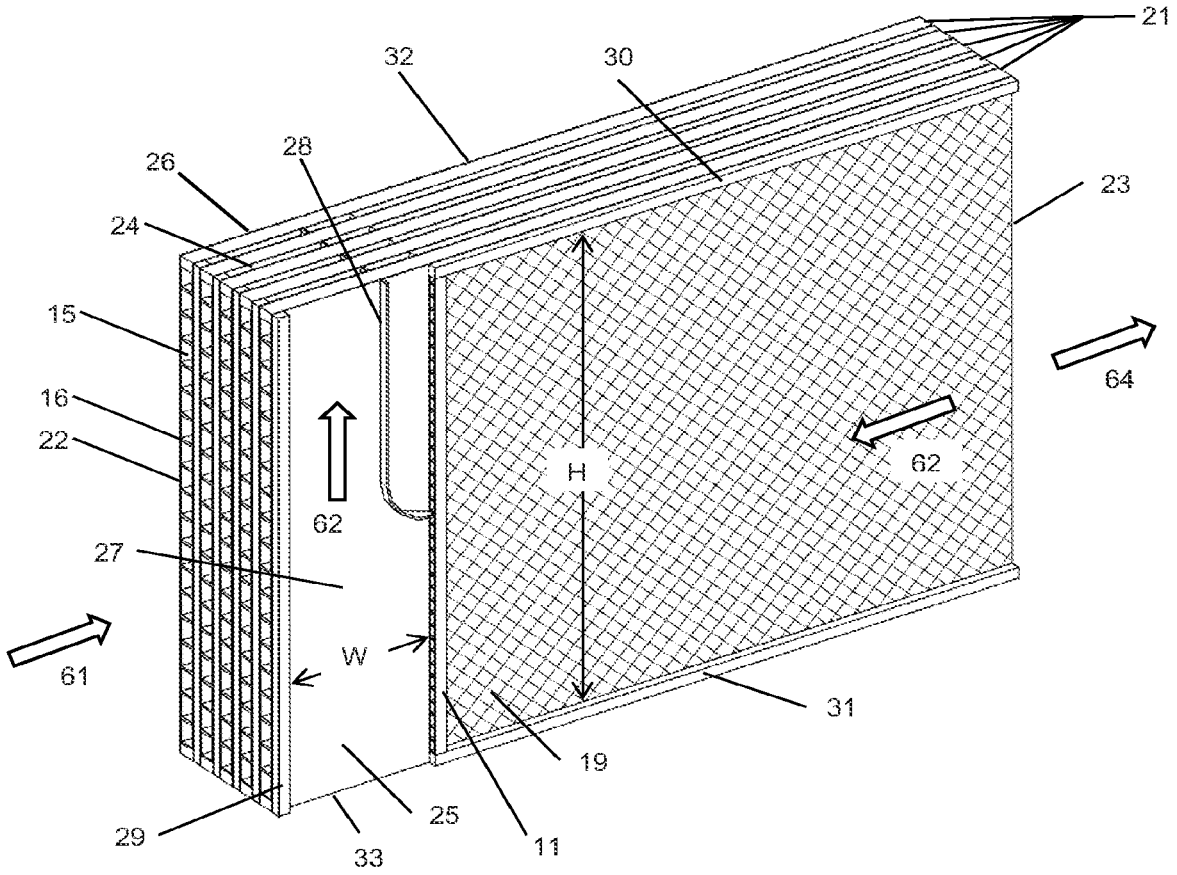
FIG. 1 is a perspective view of a five-plate core for a conventional dewpoint indirect evaporative cooler.

FIG. 1 is an illustration of five spaced apart plates [21] that is exemplary of the core of commercially available DIECs similar to the ones manufactured by StatiqCooling BV. Each plate has a front external surface [25] and a back external surface [26] each of which is a thin plastic wall in the DIECs manufactured by StatiqCooling, but which also could be a thin metal wall with a high thermal conductivity such as aluminum. The space between the front external surface [25] and the back external surface [26] define an internal passage [15], which may be subdivided into two or more internal passages by webs [16] that span the gap between the plate's front external surface [25] and back external surface [26]. (For the DIECs manufactured by StatiqCooling, the plate is made from a plastic profile extrusion so the front external surface, back external surface and internal webs are an integral piece.)

In the orientation shown in FIG. 1, process air [61] enters the dry internal passages [15] of the plate [21] at the plate's first vertical edge [22], flows horizontally within the plate [21], and exits the plate at its opposed second vertical edge [23].

The process air [61] is cooled as it flows within the dry internal passages [15] of the plate by the evaporation of water from thin wicks [19] that cover most or all of the front external surface [25] and back external surface [26] of the plate [21]. To insure good contact, the wicks are bonded to the external surfaces using a layer of adhesive that is very thin, typically less than 2 mils, and that does not fill the pores of the wick. Upon leaving the plate [21] at the plate's second vertical edge [23], approximately 20% to 50% of the cooled process air [61] turns 180 degrees and flows horizontally over the water-wetted wicks [19] on the external surfaces of the plate in a direction countercurrent to the process air [61] that flows within the plates. The air that flows over the water-wetted wicks, which will be referred to as cooling air [62], evaporates water from the wicks providing a cooling effect that is conducted across the external surfaces of the plate to the process air that flows within the plate. The portion of the process air that does not turn 180 degrees serves as the supply air [64] that provides cooling for the building.

After passing over the water-wetted wicks [19] on the external surfaces [25, 26] of the plate [21], the cooling air [62] turns 90 degrees and flows vertically off the external surface of the plate at a location where it will not mix with the process air that enters the plate at the first vertical edge. As shown in FIG. 1, the cooling air [62] turns upward. In some applications it may be preferable for the cooling air to turn downward or to split into two streams, one that flows upward and one that flows downward. In FIG. 1 a turning vane [28] assists the cooling air to turn 90 degrees with minimal disruption to the uniformity of the flow and minimal increase in pressure gradient.

As shown in FIG. 1, the turning region [27] of the plate where the cooling air turns to flow vertically, either up or downward, will typically have a width W that is smaller than the height H of region of the plate where the cooling air flows horizontally. The smaller cross sectional area for the flow implies a higher velocity for the cooling air in the turning region [27] which implies a higher pressure gradient that will increase the fan power required to move air through the DIEC. Although the wicks [19] may cover essentially all of the external surfaces[25, 26] of the plate [21], as shown in FIG. 1 it may be preferable to omit the wick from the turning region [27] of the plate so that the pressure gradient is reduced in this region and fan power is reduced.

Since the exemplary embodiment of the DIEC will have two or more spaced apart plates [21], the cooling air [62] that flows over the external surfaces of the plate will flow in the gaps [24] that are either between the spaced apart plates or between plates and the walls of the DIEC enclosure. The vertical edge seal [29] that extends the entire length of the first vertical edge [22] of the plate [21] both prevents the process air [61] from entering directly into the gap [24] between neighboring plates (or between the plate and the enclosure) and forces the cooling air [62] to turn 90 degrees.

The top edge seal [30] and the bottom edge seal [31], which extend the length of the top horizontal edge [32] and bottom horizontal edge [33] of the plate [21] from the second vertical edge to the location where the cooling air exits the gap between neighboring plates, constrain the cooling air to flow approximately horizontally prior to the cooling air turning to flow vertically.

The ability of the DIEC to cool air will be degraded if the widths of the gaps between the spaced apart plates are not equal since this non-uniformity in widths will produce a non-uniformity in the distribution of total cooling air flowing among the gaps. The vertical edge seal [29], top edge seal [30], and bottom edge seal [31] can also function as spacers that insure that all the gaps between the spaced apart plates are essentially equal in width. Additional spacers may be used to maintain uniform gaps between plates. If the additional spacers cross the flow of cooling air [62], as does the internal spacer [11] in FIG. 1, the spacer must have openings for the cooling air to pass through.

The top edge seal [30] can also assist with the delivery of water to the wicks [19] that cover the external surfaces of the plates. To perform this function the top edge seal [30] should be made of a porous, wicking, hydrophilic material, such as, but not limited to, open cell foams made from melamine, cellulose, urethane or non-woven fabrics made from fiberglass, polypropylene or other polymers. Water that is either sprayed, dripped or delivered as a jet to the top surface of the top edge seal [30] will then be spread lateral throughout the internal pores of the top edge seal. The water, having been spread along the length of the top edge seal, will then flow from the top edge seal onto the wicks [19] as a uniform film. Although in this embodiment of the invention the top edge seal is made from a porous material, the size of the pores should be sufficiently small so that when wetted with water, the top edge seal continues to constrain the cooling air to flow horizontally.

As noted in paragraph 0112 of U.S. Patent Application 2014/0260398 submitted by Kozubal, et al., a DIEC plate whose external surfaces are sheets of aluminum can be modified so that fins, such as those shown in FIG. 33 of the Kozubal application, are formed in the aluminum sheet (presumably by a slitting and stamping operation). These fins, which protrude into the internal passages [15] of the plate [21] enhance the transfer of heat between the process air [61] flowing within the plate and the external surfaces of the plate, thereby improving the performance of the DIEC.

Figure 2:
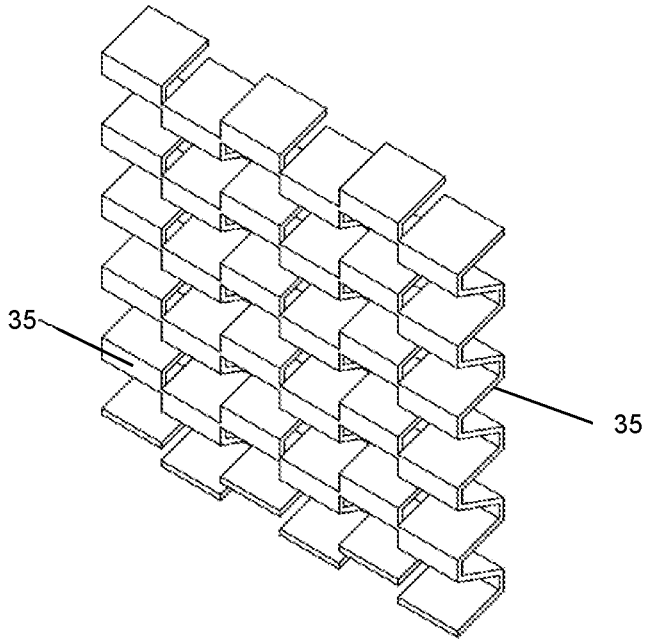
FIG. 2 is a perspective view of a fin sheet with segmented fins according to an exemplary embodiment of the present invention.

As an alternative to modifying the metal walls of a DIEC plate to create fins, exemplary embodiments of the present invention include DIEC plates that achieve a similar enhancement in heat transfer from the process air to the external surfaces of the plate by insertion of sheets of fins into the internal passage of the plate. FIG. 2 shows a fin sheet [35] that has fins [36] that are segmented, with rows of fins offset from each other in the direction of the air flow so that the thermal boundary layer on the fins is repeatedly interrupted as air flows over the fins.

Figure 3:
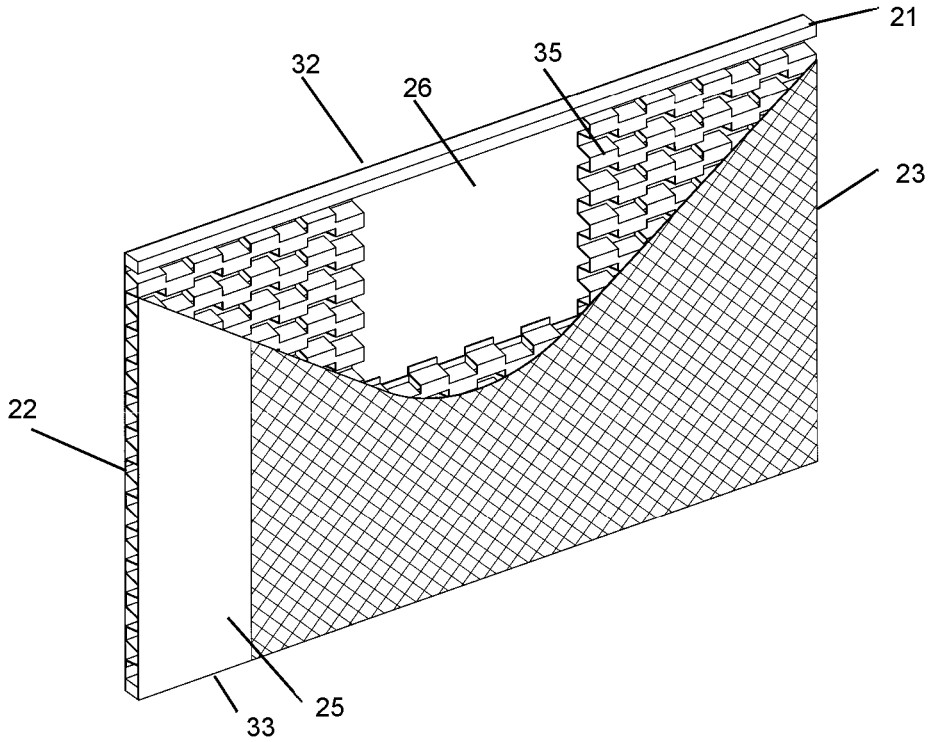
FIG. 3 is a perspective, partially cut-away view of one plate of a multi-plate dewpoint indirect evaporative cooler according to an exemplary embodiment of the present invention.

FIG. 3 shows a plate for a DIEC that has fin sheets [35] made from aluminum foil that span between and are bonded to the front external surface [25] and back external surface [26] of the plate [21]. (A section of the front external surface [25] has been removed to reveal the internal fin sheet [35], and a section of the fin sheet has been removed to reveal the back external surface [26].) The style of the fin sheet shown in FIG. 3 is the same segmented offset fins shown in FIG. 2. However, other styles of fin sheets can perform the desired enhancement in heat transfer including sheets with fins that are continuous, wavy, and lanced, and fins that create vorticity. Furthermore, although aluminum fins are commonly used in HVAC heat exchangers because of their high thermal conductivity and acceptable cost, the fins can be made from other metals such as copper. Preferably the fins are made from a metal with a thermal conductivity higher than 100 W/m-C.

Since the fin sheets [35] transfer heat to the external surfaces [25, 26] of the plate they should be bonded to the external surfaces at their points of contact to insure minimal resistance to heat transfer. Methods of bonding may include, but are not limited to, brazing, welding and gluing with a thin layer of adhesive which may be formulated to have a high thermal conductivity.

As previously noted, the fin sheets that may be used to enhance the heat transfer within a DIEC plate will commonly be made from thin sheets of a metal such as aluminum or copper that has a very high thermal conductivity. These metals are malleable, and so the fin sheets can be damaged by the inertial shocks that a DIEC may encounter when it is being shipped or otherwise moved. The fin sheets will be most vulnerable to damage near the first vertical edge [22] and second vertical edge [23] of the plate [21] and the top horizontal edge [32] and bottom horizontal edge [33] of the plate.

Figure 4:
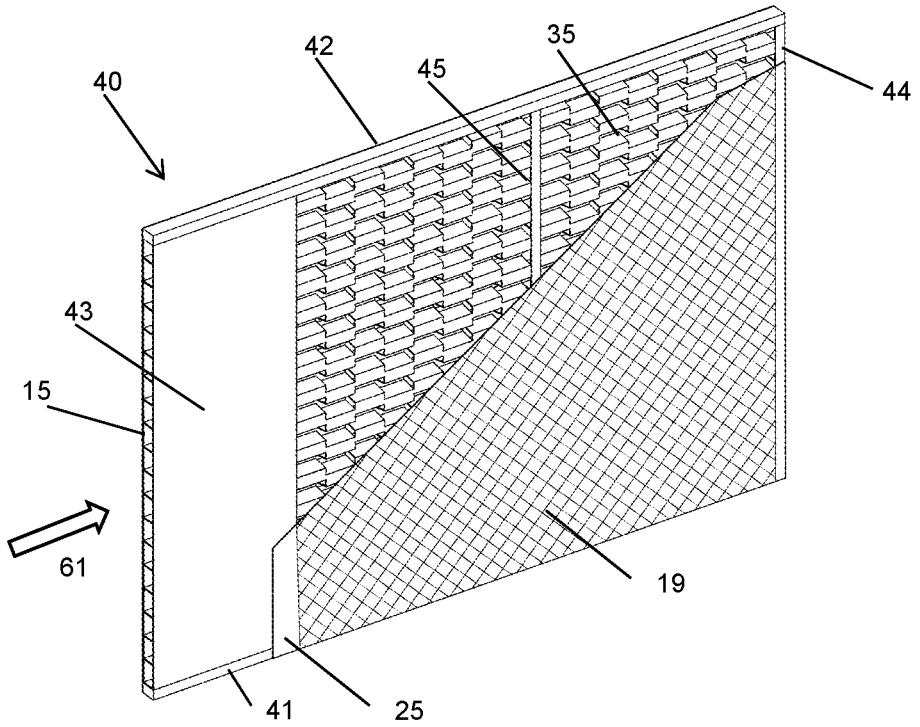
FIG. 4 is a perspective, partially cut-away view of one plate of a multi-plate dewpoint indirect evaporative cooler according to an exemplary embodiment of the present invention.

FIG. 4 shows a more robust design for a DIEC plate with two internal fin sheets [35] that are less likely to be damaged by inertial shocks. In this design, the fin sheet [35] is inset within a frame [40] with four edge sections, which are denoted as an upper edge section [42], a lower edge section [41], a front edge section [43], a back edge section [44] and an internal spanning section [45]. Although the frame [40] can be metal, a polymer frame will likely be a lower cost alternative for the DIEC. For a polymer frame, both the upper edge section and lower edge section can be made from a plastic extrusion that has a rectangular cross section or a U-shaped cross section. The front edge section, back edge section and, if present, internal spanning section must all allow the process air [61] to flow through the plate's internal passage [15] (or passages). This requirement can be met by making these three section of the frame from a plastic profile extrusion that has internal passages and aligning the internal passages of the extrusion in a direction that allows the process air to flow through the plate. The requirement could also be met by making one or more of these three sections of the frame from strips of thin, corrugated material or from a rigid open cell foam.

If made from more than one piece, the rigidity of the frame [40] can be increased by bonding separate pieces together at the joints where they meet. The front external surface [25] and the back external surface [26] of the plate [21] may also be bonded to the frame [40] along the lines of contact so that process air cannot flow in gaps that might be between the frame and the external surfaces.

The frame-type construction of the plate shown in FIG. 4 could also be used to protect heat-transfer enhancing slit fins or other protuberances that are formed in the metallic wall of a plate such as those described in U.S. Patent Application 2014/0260398.

As noted in the discussion of FIG. 1, the velocity of the cooling air will typically be greater in the region where it turns to flow vertically compared the region where it flows horizontally due to the reduction in cross sectional area available for the flow after it turns vertically. This higher velocity produces larger pressure gradients that then lead to higher fan power for the DIEC, which is a clear penalty on the performance of the DIEC. This penalty can be reduced or eliminated by reducing the thickness of the DIEC's plates in their turning regions [27].

Figure 5:
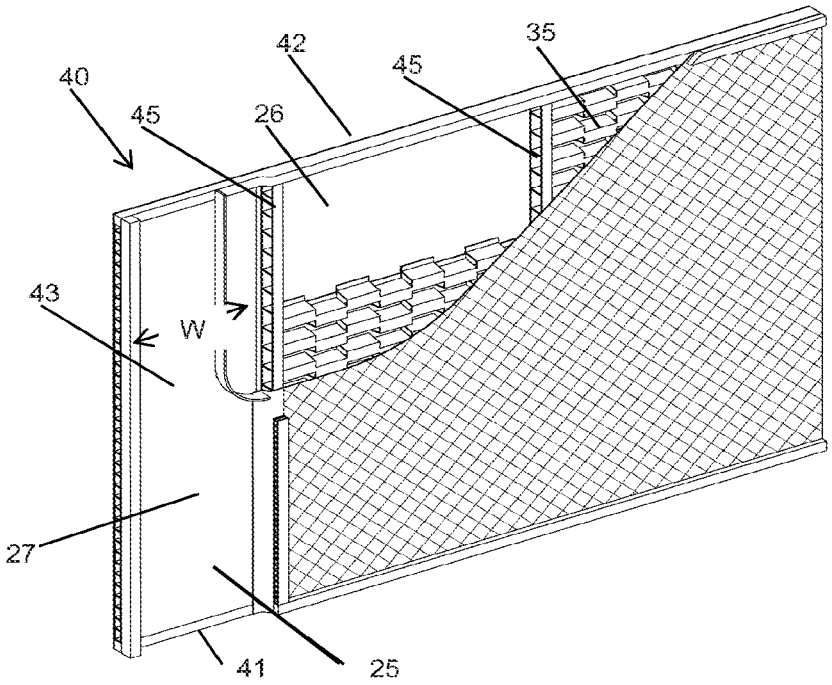
FIG. 5 is a perspective, partially cut-away view of one plate of a multi-plate dewpoint indirect evaporative cooler according to an exemplary embodiment of the present invention.

FIG. 5 shows a DIEC plate with a polymer frame [40] that has a front edge section [43] that has a width that is approximately equal to the width W of the turning region [27]. The thickness of this front edge section [43] is less than the thickness of the other sections of the frame (whose thickness determine the thickness of the plate in the region where the fin sheet [35] is inserted within the frame [40]). The frame also has two internal spanning sections [45], one of which is parallel to and in close proximity to the front edge section [43]. These internal spanning sections [45] have the same thickness as the section of the plate that has the fin sheets [35].

The DIEC plate shown in FIG. 5 will be thinner where the front external surface [25] and the back external surface [26] join to the front edge section [43] of the frame [40]. When plates are stacked apart to form the core of a DIEC, the gap between plates will be widest where the plates are thinnest. Since the plates are thinnest in the plate's turning region [27], the wider flow area for the cooling flow will reduce the cooling flow's velocity, which then reduces the pressure gradient and fan power.

Figure 6:
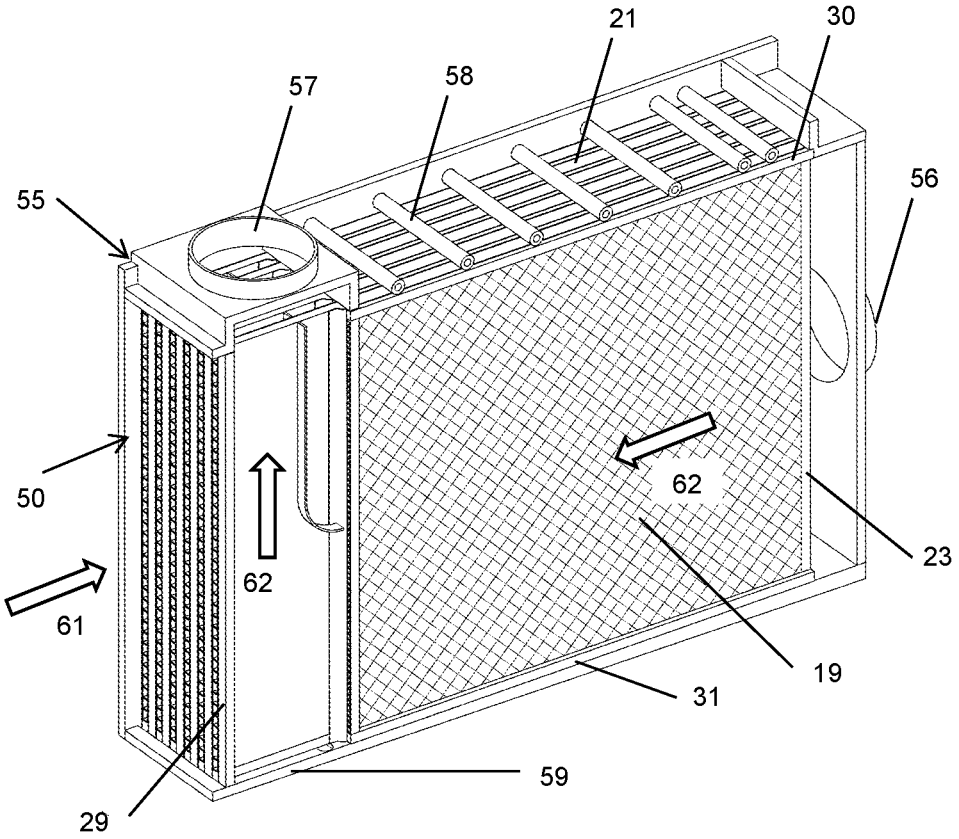
FIG. 6 is a perspective view of a dewpoint indirect evaporative cooler according to an exemplary embodiment of the present invention.

FIG. 6 shows a DIEC that has a core [50] of six spaced apart plates [21]. In this figure, the plates have the same construction as that shown in FIG. 5, although plates with the construction shown in either FIG. 1, 3 or 4 could also form the core. The core [50] is mounted within an enclosure [55] that has a supply duct fitting [56] through which cooled process air is supplied to the building and an exhaust duct fitting [57] through which cooling air is drawn from the enclosure and discharged to ambient. The front panel of the enclosure has been removed so that the internal features of the DIEC are shown.

Although air can be pushed through the DIEC by a fan mounted at the face of the enclosure where the process air [61] enters the enclosure, the enclosure shown in FIG. 6 is designed for a fan arrangement that pulls air through the DIEC: the fan that supplies air to the building is mounted downstream of the supply duct fitting [56] and the fan that draws cooling air through the DIEC is mounted downstream of the exhaust duct fitting [57].

In FIG. 6, the top edge seals [30] are made from a porous, wicking, hydrophilic material. Water is supplied to each top edge seal [30] at seven locations along the length of the top edge seal. (Depending on the length of the top edge seal, it may be desirable to supply water at a different number of locations.) The water delivery pipe [58] that supplies water at each location has a series of holes that align with the top edge seals [30]. Water then flows from the water delivery pipe as either a continuous jet or pulsed jet directly onto the top edge seal [30]. From the top edge seals the water spreads out onto the thin wicks [19] that cover the external surfaces of the plates [21]. A portion of the water evaporates into the cooling air and a portion flows off the bottom of the plates onto the bottom panel [59] of the enclosure [55]. The flow of cooling air [62] in the gaps between the plates moves the water on the bottom panel of the enclosure towards a drain opening (which is not shown) in the bottom panel.

All evaporative coolers that use mineral-laden water must deal with potential maintenance problems caused by scale formation (i.e., the precipitation of minerals as water evaporates and the unevaporated water becomes supersaturated with minerals). During the operation of the DIEC shown in FIG. 6, the potential for scale formation will be greatest at the location where the cooling air first enters the gaps between plates (i.e., near the second vertical edge[23] of the plates). At this location, the cooling air will be driest and, consequently evaporation rates will be at their greatest.

Potential maintenance problems caused by scale formation may be reduced or eliminated by a design and arrangement of water distribution pipes [58] that delivers more water to the sections of plates where the evaporation rates are highest. Higher localized delivery rates of water can be achieved by means that include, but are not limited to: (1) spacing the water distribution pipes at smaller intervals (as shown in FIG. 6 at the ends of the plates nearest the supply duct fitting [56]), (2) increasing the size or number of the holes in one or more distribution pipes, (3) when the delivery of water is pulsed, increasing the duration of the pulses from one or more distribution pipe, and/or (4) increasing the pressure within one or more distribution pipes.

As previously noted, the vertical edge seal [29], top edge seal [30], and bottom edge seal [31] that are between neighboring plates in the DIEC shown in FIG. 6 will maintain uniform gaps between neighboring plates. Furthermore, it has been noted that additional spacers can be used to insure the uniformity of gaps. However, it may be advisable not to locate spacers near the second vertical edge [23] of the plates since evaporation rates are highest at this location and the potential for scale formation is greatest. For DIEC designs that do not have spacers near the second vertical edge of the plates, routine maintenance procedures could include inserting a brush or scraper into the gaps between plates to remove scale.

A dewpoint indirect evaporative cooler falls within a class of thermal devices that function as heat and mass exchangers: thermal energy (i.e., heat) is exchanged between the air flowing within the DIEC's plates and the air flowing in the gaps between plates, and mass (i.e. water) is exchanged between the wetted wicks and the cooling air flowing over the wicks. Many of the aspects of the invention so far disclosed can be applied in heat and mass exchangers other than DIECs. In particular, the plate shown in FIG. 7 could be used in an indirect evaporative cooler that uses ambient air directly as the cooling air (without first precooling the ambient air) and in which the cooling air and the process air flow counter to each other for a substantial portion of the plate's length. Similar to the plate in FIG. 5, the plate in FIG. 7 has a polymer frame [40] which has a front edge section [43] that is thinner than the plate's thickness in the region where the wick [19] and underlying fin sheet are located. However, the plate in FIG. 7 differs from that in FIG. 5 in that its frame also has a thinner back edge section [44].

Figure 7:
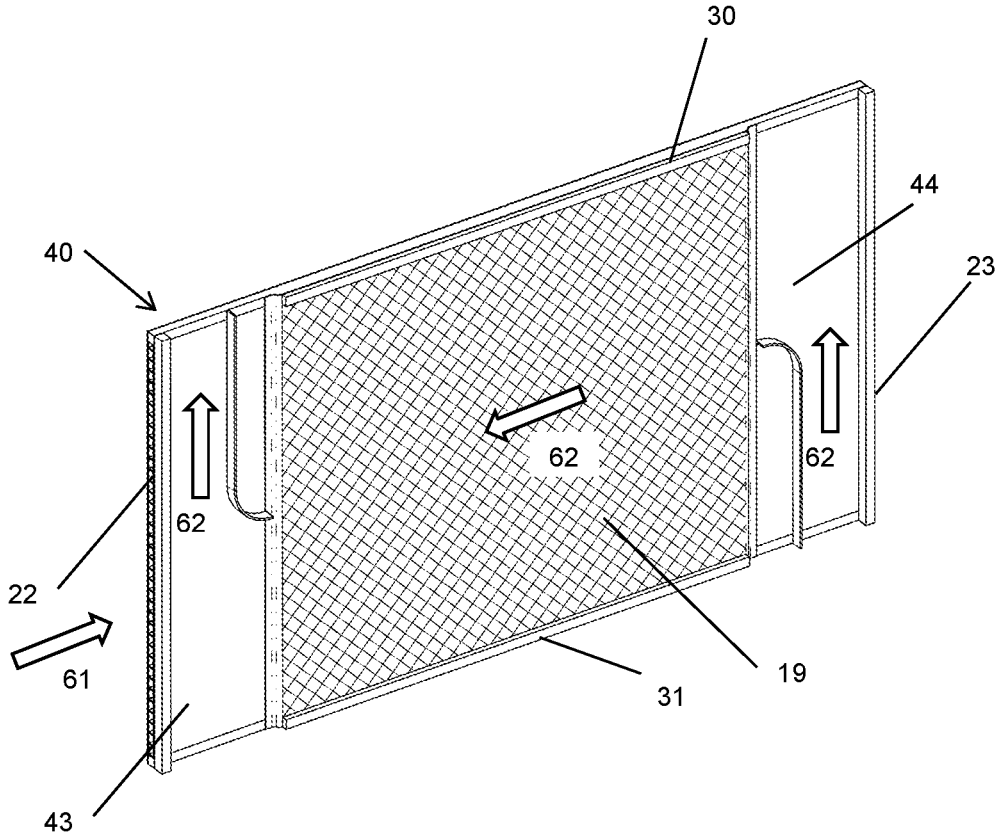
FIG. 7 is a perspective view of one plate of a multi-plate dewpoint indirect evaporative cooler according to an exemplary embodiment of the present invention.

When plates shown in FIG. 7 are arranged spaced apart, the gaps between plates will be wider at both the first vertical edge [22] and second vertical edge [23] of the plates. Cooling air [62] can enter vertically into the wider gaps at the plates' second vertical edge, turn 90 degrees to flow horizontally over the water-wetted wicks on the external surfaces of the plates, and finally turn 90 degrees to exit vertically from the wide gaps at the plates' first vertical edge. Process air [61] can flow counter to the cooling air, entering the plates at their first vertical edge and leaving at their second vertical edge.

Internally cooled liquid-desiccant absorbers are also a type of heat and mass exchanger that could benefit from aspects of the invention. In particular, a liquid-desiccant absorber that is internally cooled with ambient air could use the plates shown in FIG. 7. When operating as part of a liquid-desiccant absorber, the wicks [19] that cover the front external surface and back external surface of the plate are wetted with a hygroscopic liquid desiccant. The process air to be dried and cooled flows in the gaps between plates in direct contact with the desiccant-wetted wicks (following the path for the cooling air [62] in FIG. 7). The liquid desiccant absorbs water vapor from the process air. The heat that is released as the liquid desiccant absorbs water vapor is transferred across the external surfaces of the plate to cooling air [61] that flows horizontally within the plates in a direction counter to the process air.

Thermal devices that transfer heat between two fluid streams but not mass, which are commonly called heat exchangers, can also benefit from many aspects of the invention. In particular, heat exchangers composed of plates that use thin fins made from a malleable metal to enhance heat transfer can be damaged by inertial shocks. A modified version of the plate shown in FIG. 4 can be applied to a finned, plate-type heat exchanger so that its fins are protected from damage. Since the heat exchanger does not either absorb or desorb mass into a falling film of liquid, the thin wicks [19] that cover the front external surface [25] and back external surface of the plate shown in FIG. 4 would be omitted and the plates would not necessarily be oriented vertically. As shown in FIG. 4, the plate for the heat exchanger has a fin sheet [35] that is inset within a frame [40], which again can be metal or plastic, and which will have the same characteristics as those previously described for the plate for a DIEC.

Since the plates may not be vertical when applied to a heat exchanger, it will be useful to refer to the parts of the frame and plate in ways that are independent of orientation. In particular, the top horizontal edge [32] of the plate may be described as the first stream-wise edge (where it is noted that this edge will always be parallel to the direction of the process air); the bottom horizontal edge [33] of the plate may be described as the second stream-wise edge; the first vertical edge [22] of the plate may be described as the first cross-stream edge; the second vertical edge [23] of the plate may be described as the second cross-stream edge; the upper edge section [42] of the frame may be described as the first stream-wise edge section; and the lower edge section [41] of the frame may be described as the second stream-wise edge section. The reference to parts of the frame as "front edge section" and "back edge section" do not depend on orientation and so are not given alternate descriptions.

Heat exchangers with a core composed of plates and which benefit from the counter flow of the hot and cold fluid streams through the core must have a means by which the hot and cold fluid streams can enter and leave the core without cross flow between the two fluid streams (i.e., there is no fluid communication between the two streams). U.S. Pat. No. 4,314,607 (DesChamps) discloses a means of sealing portions of the edges of the planar metal sheets that comprise the core of a heat exchanger so that separate openings are created at the ends of the core through which the two fluid streams enter and leave the core without cross flow between the two streams while maintaining the two fluid streams in essentially a counter-flow orientation within the core.

A modified version of the plate shown in FIG. 7 can be applied to a heat exchanger that maintains two fluid streams in an essentially counter-flow relationship through its core and prevents fluid communication between the two streams at the fluid entrance to and exit from the core. Since the heat exchanger does not either absorb or desorb mass into a falling film of liquid, the thin wicks [19] that cover the front external surface [25] and back external surface of the plate shown in FIG. 7 would be omitted and plates would not necessarily be oriented vertically. As shown in FIG. 7, the plate for the counter-flow heat exchanger has a polymer frame [40] which has a front edge section [43] and a back edge section [44] both of which are thinner than the plate's thickness in the region where the fin sheet is located. All aspects of the frame previously described for the plate shown in FIG. 7 would apply to plates used in a counter-flow heat exchanger.

The following Detailed Implementation of the Invention is provided merely for illustrative purposes and is not intended to limit the various inventive features in any way.

DETAILED IMPLEMENTATION OF THE INVENTION

The core of a commercial DIEC composed of 65 plates with the construction shown in FIG. 5 that supplies 1,250 cfm of cooled air to a building has been designed. The overall length and width of each plate are 85 cm×59 cm. The length and width of the section of plate covered by wicks are 67 cm.×56 cm. The width W of the plates' turning regions [27] is 18 cm.

The front edge section [43] of the frame [40] is a polycarbonate profile extrusion that is 6 mm thick and 18 cm wide. The back edge section [44] and the internal spanning section [45] are a polycarbonate profile extrusion that is 10 mm thick and 1.3 cm wide. The upper edge section [42] and lower edge section [41] are both polycarbonate and are 6 mm thick over the length that joins to the front edge section [43] and 10 mm thick over the balance of their length.

The front external surface and back external surface of the plates are films of aluminum that are no thicker than 4 mil and that have 1 mil thick layers of acrylic-based pressure-sensitive adhesive on both faces. The fin sheets are formed from 3 mil aluminum foil. The height of the fins is 10 mm, their length in the direction of air flow is 3.5 mm and their pitch is 3.2 mm.

Each fin sheet fits within the rectangular openings in the frame formed by the frame's internal spanning section, upper edge section, lower edge section and back edge section. The pressure sensitive adhesive on one face of the front external surface and the back external surface bonds these external surfaces to both the frame and the portions of the fins that contact these external surfaces.

A wick composed of a 20 mil thick sheet of non-woven fiberglass is bonded to the front external surface and the back external surface by the pressure sensitive adhesive on the outer face of these surfaces.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

What is claimed is:

1. A plate for a heat exchanger comprising:

a) a front surface;

b) a back surface;

c) a frame having a first cross-stream edge, an opposed second cross-stream edge, a first stream-wise edge and an opposed second stream-wise edge, the frame comprising:

(i) a front cross-piece that defines the first cross-stream edge, an opposed back cross-piece that defines the second cross-stream edge, a first side cross-piece that defines the first stream-wise edge, an opposed second side cross-piece that defines the second stream-wise edge, and at least one internal cross-piece that is parallel to the front cross-piece and that spans the space between the first and second side cross-pieces;

(ii) internal passages formed in the front cross-piece, the back cross-piece, and the internal cross-piece of the frame that permit a process fluid to flow through the plate in a direction parallel to the first and second stream-wise edges, wherein the frame is bonded to the front and back surfaces of the plate around the periphery of the front and back surfaces so as to be disposed between the front and back surfaces;

d) fins or other protuberances that enhance heat transfer between the process fluid flowing within the plate and the front and back surfaces of the plate, the fins or other protuberances being located within one or more volumes defined by the cross-pieces of the frame and the front and back surfaces and having a height that spans from the front surface to the back surface, wherein a thickness of the front cross-piece or the back cross-piece is less than the height of the fins or protuberances.

2. The plate for a heat exchanger of claim 1, wherein the frame is made from a polymer.

3. The plate for a heat exchanger of claim 1, wherein the front and back surfaces are metal foils having a thickness equal to or less than 4 mil.

4. The plate for a heat exchanger of claim 1, further comprising a turning region in which a thickness of the plate is less than the height of the fins or other protuberances and in which a cooling fluid flowing over the outside of the plate is directed at a nonzero angle relative to the first and second stream-wise edges.

5. The plate for a heat exchanger of claim 1, further comprising a wick that covers a fraction of one or both of the front and back surfaces and that uniformly spreads a liquid so that the plate is adapted for mass exchange.

6. A heat and mass exchanger comprising:

(a) two or more vertically oriented and spaced apart plates, each of the two or more plates comprising:

i) front and back surfaces;

ii) a wick that covers at least a portion of at least one of the front and back surfaces and that uniformly spreads a liquid so that the plate is adapted for mass exchange;

iii) a frame having a first cross-stream edge, an opposed second cross-stream edge, a first stream-wise edge and an opposed second stream-wise edge, the frame comprising:

(1) a front cross-piece that defines the first cross-stream edge, an opposed back cross-piece that defines the second cross-stream edge, a first side cross-piece that defines the first stream-wise edge, an opposed second side cross-piece that defines the second stream-wise edge, and at least one internal cross-piece that is parallel to the front cross-piece and that spans the space between the first and second side cross-pieces (2) internal passages formed in both the front cross-piece, the back cross-piece, and the internal cross-piece of the frame that permit a first fluid to flow through the plate in a direction parallel to the first and second stream-wise edges, wherein the frame is bonded to the front and back surfaces of the plate around the periphery of the front and back surfaces so as to be disposed between the front and back surfaces:

iv) fins or other protuberances that enhance heat transfer between the process fluid flowing within the plate and the front and back surfaces of the plate, the fins or other protuberances being located within one or more volumes defined by the cross-pieces of the frame and the front and back surfaces and having a height that spans from the front surface to the back surface, wherein a thickness of the front cross-piece or the back cross-piece is less than the height of the fins or protuberances, (b) means for delivering the liquid to the wicks in proximity to the uppermost stream-wise edge of each plate, (c) means for directing the first fluid into the plates at their first cross-stream edge and out of the plates at their second cross-stream edge, (d) means for directing a second fluid in gaps between the plates in contact with the liquid-wetted wicks and in a direction counterflow to the first fluid so that mass is exchanged between the second fluid and the liquid.

7. The heat and mass exchanger of claim 6, wherein the second fluid is a portion of the first fluid that exits the plates at their second cross-stream edge.

8. A heat and mass exchanger of claim 7, wherein the liquid is water.

9. A heat and mass exchanger of claim 6, wherein the liquid is a liquid desiccant.

10. The heat and mass exchanger of claim 6, wherein at least one of the two or more frames is made from a polymer.

11. The heat and mass exchanger of claim 6, wherein the front and back surfaces are metal foils having a thickness equal to or less than 4 mil.

12. The heat and mass exchanger of claim 6, wherein each of the two or more vertically oriented, spaced-apart plates has a turning region in which the second fluid is directed at a nonzero angle relative to the first and second stream-wise edges of the at least one of the two or more frames.

* * * * *